US006431097B1

(12) United States Patent
Meade et al.

(10) Patent No.: US 6,431,097 B1
(45) Date of Patent: Aug. 13, 2002

(54) LOOP MODULE FOR TUFTING MACHINE

(75) Inventors: Warren John Meade; Angela Margaret Phillips; Jonathan William Clarke, all of Christchurch (NZ)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 09/719,717

(22) PCT Filed: Jun. 18, 1999

(86) PCT No.: PCT/EP99/04247

§ 371 (c)(1),
(2), (4) Date: Dec. 15, 2000

(87) PCT Pub. No.: WO99/67458

PCT Pub. Date: Dec. 29, 1999

(30) Foreign Application Priority Data

Jun. 19, 1998 (NZ) ..... 330750

(51) Int. Cl.[7] ..... D05C 15/22
(52) U.S. Cl. ..... 112/80.5
(58) Field of Search ..... 112/80.5, 80.52, 112/80.53

(56) References Cited

U.S. PATENT DOCUMENTS

| | | | | | |
|---|---|---|---|---|---|
| 2,411,268 | A | * | 11/1946 | Hamrick | 112/80.5 |
| 3,095,840 | A | * | 7/1963 | Ballard | |
| 4,303,024 | A | | 12/1981 | Bardsley | |
| 4,470,360 | A | * | 9/1984 | Gerlach | 112/80.5 |
| 4,739,717 | A | | 4/1988 | Bardsley | |

FOREIGN PATENT DOCUMENTS

| | | | | |
|---|---|---|---|---|
| DK | 57347 | * | 3/1940 | 112/80.5 |
| GB | 2196996 | | 5/1988 | |

* cited by examiner

*Primary Examiner*—Ismael Izaguirre
(74) *Attorney, Agent, or Firm*—Selitto, Behr & Kim

(57) ABSTRACT

Loop pile hook module for use in a tufting machine, the module has a body member including a plurality of tufting machine hooks therein in side-by-side relationship, the hooks being formed from cylindrical, or other profile, pins which protrude from the body member to form a beak of the hooks.

8 Claims, 3 Drawing Sheets

LOOP MODULE FOR TUFTING MACHINE

FIELD OF THE INVENTION

This invention relates to tufting machines and more particularly to loop pile hook modules.

BACKGROUND TO THE INVENTION

In a tufting machine a multiplicity of yarn carrying needles penetrate a foundation or backing sheet and loops of yarn are formed therein by loopers which seize the yarn which the loops are shed thereby producing a loop pile article.

As the gauge of tufted products have decreased, i.e. the spacing between adjacent rows of stitches and thus between respective needles and loopers or hooks, modules have been developed wherein the shanks of the respective loopers or hooks are embedded in a common body in side-by-side disposition. Such module looper constructions are illustrated in U.S. Pat. Nos. 4,303,024 and 4,739,717. These modular constructions substantially eliminate the difficulty of aligning hooks or loopers in a respective hook or looper bar of a tufting machine since the hooks or loopers are aligned in a jig during the formation of the module.

A recent trend toward lower pile height carpets has necessitated the development of low profile hooks to enable these products to be manufactured. With conventional hook designs the profile can only be reduced to a limited extent and alternative designs need to be considered to enable ultra low pile height to be achieved.

One difficulty with modular construction is that of replaceability of a broken gauge part, i.e. a hook or looper. If a gauge part breaks, or becomes damaged, the entire module must be removed and replaced. The module being generally discarded. Although possible, in practice partially damaged modules are generally not remanufactured. Thus, it is necessary for these relatively expensive components, i.e. modules, to be discarded prior to the complete exhaustion of their useful economic life. Although damage to loopers is not a common occurrence it can not be entirely eliminated so one alternative is to develop lower cost modular parts to reduce the lost economic value associated with discarding of a module.

Conventional hooks or loopers are made in relatively complex shapes from alloyed steel flat sheet having a body portion comprising a blade and a shank. The shank includes the mounting portion and extends forwardly relative to the blade, i.e. toward backing feed supply rollers. The hooks are disposed in a jig and the body member is cast about the hooks from a material which is commonly used in the art such as low melting point Zinc/lead/aluminum.

The usual arrangement is for the hooks to extend out of the top of the body member with a beak located at the end of the blade and separated from the body member by 20 millimeters or more. With this arrangement, fibers loosened from the yarn are able to lodge between the shanks of adjacent hooks and, if not cleared regularly, accumulate over time to eventually become densely packed and cause problems with the tufting action.

Another disadvantage of the conventional hook design is that the relatively long hook blade is flexible and can be deflected by the needle resulting in poor yarn pick up which in turn can result in an irregular pile surface.

Consequently it is the primary object of the present invention to provide a loop pile hook module for a tufting machine which can be manufactured at relatively low cost and which overcomes the disadvantage identified above.

It is another object of the present invention to provide a loop pile hook module for a tufting machine which can be used to make low pile height fabrics.

It is further object of the present invention to provide a loop pile hook module for a tufting machine which can be used to make fine gauge products.

SUMMARY OF THE INVENTION

According to a broadest aspect of the invention there is provided a loop pile hook module for use in a tufting machine, the module has a body member including a plurality of tufting machine hooks therein in side-by-side relationship, the hooks being formed from cylindrical, or other profile, pins which protrude from the body member to form a beak of the hooks.

The body member may be molded, fabricated or otherwise constructed with the hooks cast, mounted or otherwise fixed in a side-by-side relationship therein.

Further aspects of the invention which should be considered in all its novel aspects will become apparent from the following description which is given by way of example only.

DESCRIPTION OF THE DRAWINGS

Examples of the invention will now be described with reference to the accompanying drawings in which:

In FIGS. 1 to 4 is shown a conventional looper module generally indicated by arrow 1. In this looper module 1 each of the loopers 2 is constructed from a flat sheet comprising a blade 3, a shank 4 and beak 5. The loopers 2 are cast in a body member 6 which is constructed from an alloy metal material. The body member 6 includes a shaped mount for fixing the looper module to a looper bar of a tufting machine.

DESCRIPTION OF PREFERRED EMBODIMENTS

Figure 1:
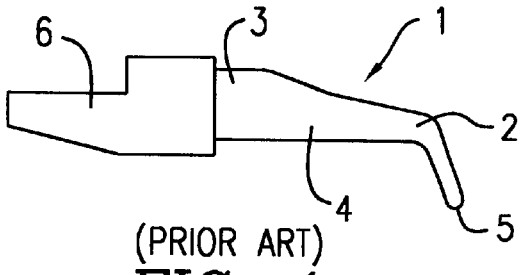
(PRIOR ART) FIG. 1
FIG. 1 shows a side view of a conventional looper module.
Figure 2:
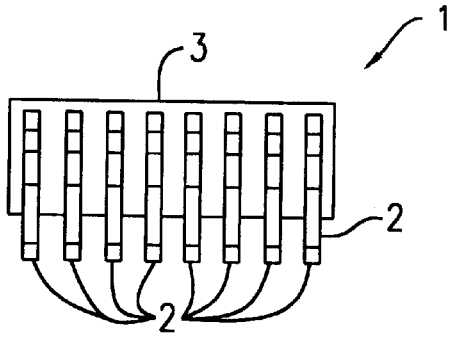
(PRIOR ART) FIG. 2
FIG. 2 shows a front view of the looper module shown in FIG. 1.
Figure 3:
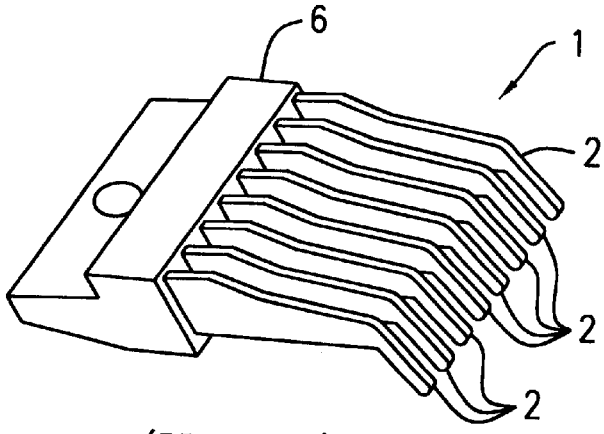
(PRIOR ART) FIG. 3
FIG. 3 shows a perspective view from above of the looper module shown in FIGS. 1 and 2.
Figure 4:
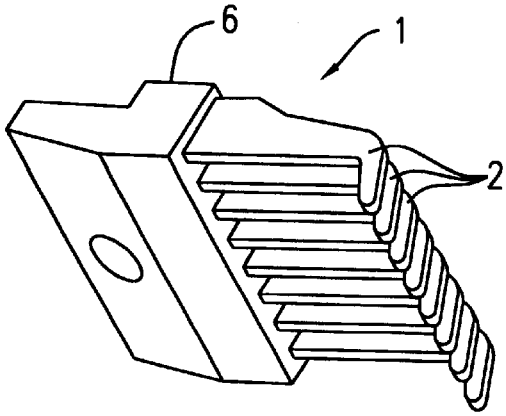
(PRIOR ART) FIG. 4
FIG. 4 shows a perspective view from below of the looper module shown in FIGS. 1, 2 and 3.
Figure 5:
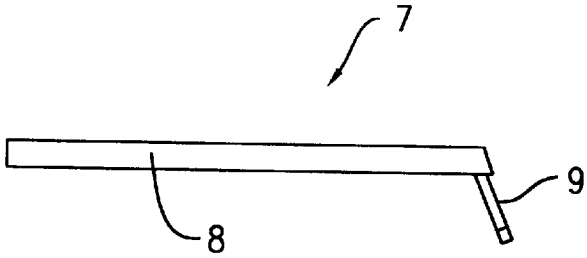
FIG. 5 shows a side view of a version of the new looper module according to the invention.
Figure 6:
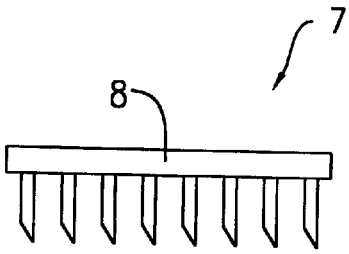
FIG. 6 shows an end view of the looper module shown in FIG. 5.
Figure 7:
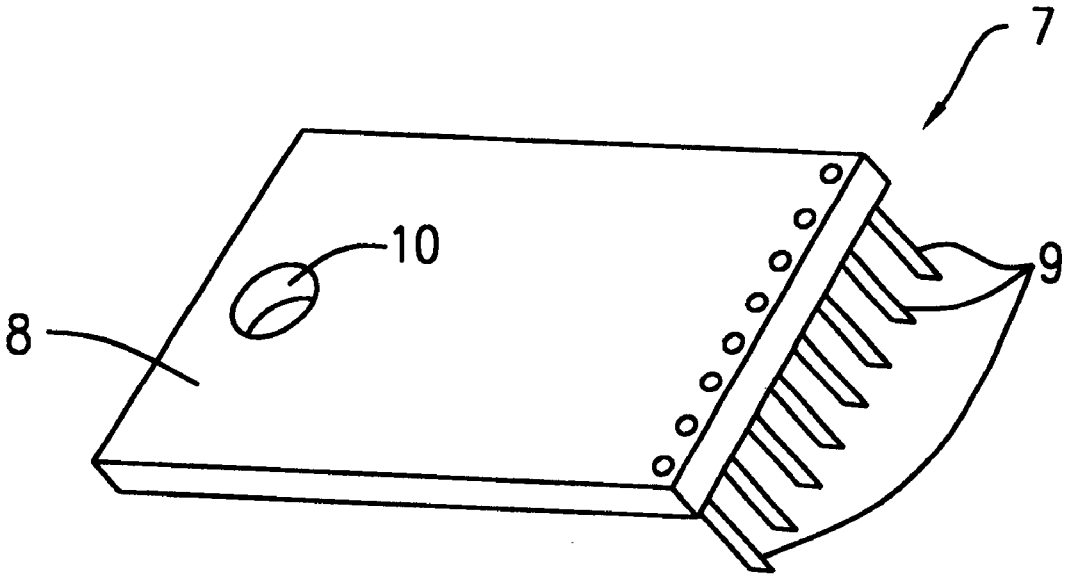
FIG. 7 shows a perspective view from above of the looper module shown in FIGS. 5 and 6.
Figure 8:
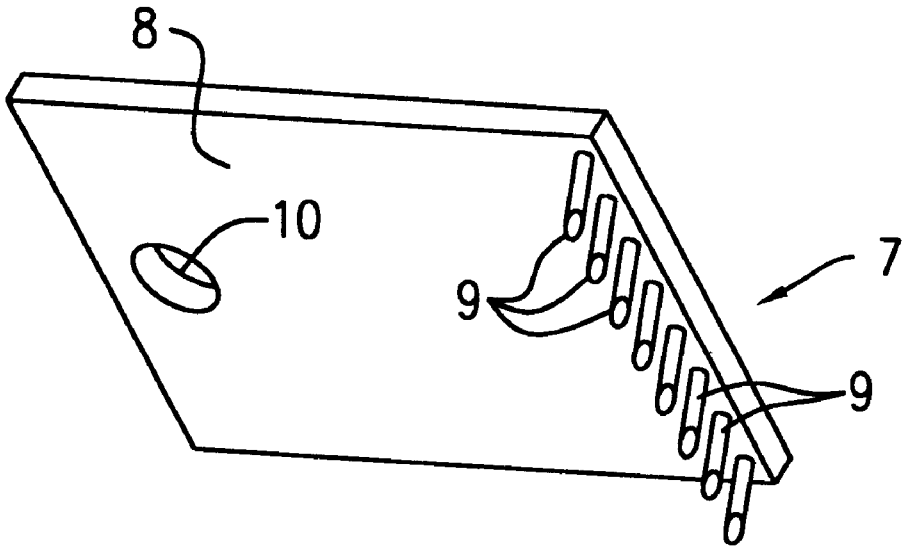
FIG. 8 shows a perspective view from above of the looper module shown in FIGS. 5, 6 and 7.

In FIGS. 5 to 8 is shown an example of looper module according to the present invention.

The looper module 7 consists of a body member 8 with a plurality of tufting machine hooks 9. The tufting machine hooks 9 are formed from a cylindrical or other profile pins. The pins protrude from the body member 8 and form a beak of the hook 9. As shown in the drawings each of the pins are straight and may be beveled.

The body member 8 may include a mounting hole or holes 10 (FIGS. 7 and 8) used to fix the looper module in place on a looper bar of a tufting machine.

An advantage of the present invention is that the modular loop pile hooks for the tufting machine do not deflect through contact with the tufting needle and reduce the chances of irregular pile surface due to poor loop pick up arising through this agency.

Another advantage of the present invention is the provision of a loop pile hook module for a tufting machine which is disposed to prevent the accumulation of loose fibers between the shanks of adjacent hooks and thereby promote trouble-free tufting.

Where in the description known integers have been used, it is envisaged that their equivalents may be substituted even though they are not individually set forth therein.

Particular examples of the invention have been described and it is envisaged that improvements and modifications can take place without departing from the scope thereof.

We claim:

1. In a loop pile hook module including a body member having tufting machine hooks, which are fixed to said body member and which protrude therefrom, and means to fix said module to a looper bar of a tufting machine, the improvement wherein said tufting machine hooks are straight, cylindrically-shaped pins, which are not deflectable by a tufting needle.

2. An improved pile hook module according to claim 1, wherein each of said pins has a fixed end which is cast in said body member.

3. An improved pile hook module according to claim 2, wherein each of said pins has a free end opposite said fixed end thereof, said free end being beveled.

4. An improved pile hook module according to claim 1, wherein said pins are made of stainless steel.

5. An improved pile hook module according to claim 1, said body member is made of a metal having a low melting point.

6. An improved loop pile hook module according to claim 5, wherein said metal is zinc.

7. An improved loop pile hook module according to claim 5, wherein said metal is lead.

8. An improved loop pile hook module according to claim 5, wherein said metal is aluminum.

* * * * *